US011459935B2

(12) United States Patent
Won

(10) Patent No.: US 11,459,935 B2
(45) Date of Patent: Oct. 4, 2022

(54) DEVICE FOR PREVENTING BACKWARD AIR FLOW OF RESERVOIR TANK FOR VEHICLE

(71) Applicants: HYUNDAI MOTOR COMPANY, Seoul (KR); KIA CORPORATION, Seoul (KR)

(72) Inventor: Seung Hyun Won, Gunpo-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/241,767

(22) Filed: Apr. 27, 2021

(65) Prior Publication Data

US 2022/0074339 A1 Mar. 10, 2022

(30) Foreign Application Priority Data

Sep. 8, 2020 (KR) ..... 10-2020-0114270

(51) Int. Cl.
*F01P 11/02* (2006.01)
*F01P 7/14* (2006.01)

(52) U.S. Cl.
CPC ..... *F01P 7/14* (2013.01); *F01P 11/028* (2013.01)

(58) Field of Classification Search
CPC . F02M 25/0221; F01P 11/029; F01P 11/0276; F01P 11/028; F01P 11/0285
See application file for complete search history.

(56) References Cited

U.S. PATENT DOCUMENTS 3,576,181 A * 4/1971 Neal ..... F01P 11/028 123/41.51
4,476,819 A * 10/1984 Szloboda ..... F02M 25/035 123/585
4,507,056 A * 3/1985 Allen ..... F04F 1/10 417/54
5,111,776 A * 5/1992 Matsushiro ..... F01P 11/02 123/41.29
5,358,009 A * 10/1994 Cambell ..... B67D 7/002 137/589
5,699,759 A * 12/1997 Hollis ..... F01P 3/20 123/41.1
2005/0120715 A1* 6/2005 Labrador ..... F03G 7/00 60/618
2006/0144865 A1* 7/2006 Yoshida ..... A47J 41/0033 222/399
2006/0216105 A1* 9/2006 Byun ..... A46B 11/0041 401/270
2007/0113893 A1* 5/2007 Sun ..... F04B 33/00 222/401

(Continued)

*Primary Examiner* — Long T Tran
(74) *Attorney, Agent, or Firm* — McDonnell Boehnen Hulbert & Berghoff LLP

(57) ABSTRACT

The present disclosure provides a device for preventing the backward air flow of a reservoir tank for a vehicle, which may mount an backward air flow prevention tube extending to coolant on a connector of a reservoir tank to which a degassing hose is connected, and form an air collection slit hole communicating with an upper space of the reservoir tank in the upper portion of the tube to be openable or closable, thereby easily preventing the phenomenon in which the air within the reservoir tank flows back toward an engine, and easily collecting the air introduced from the engine side.

7 Claims, 10 Drawing Sheets

(56) References Cited

U.S. PATENT DOCUMENTS

2010/0089913 A1* 4/2010 Dexter ..... F01P 11/029
220/4.12
2019/0248231 A1* 8/2019 Gross ..... B60K 15/03519

* cited by examiner

DEVICE FOR PREVENTING BACKWARD AIR FLOW OF RESERVOIR TANK FOR VEHICLE

CROSS REFERENCE TO RELATED APPLICATIONS

This application claims under 35 U.S.C. § 119(a) the benefit of priority to Korean Patent Application No. 10-2020-0114270 filed on Sep. 8, 2020, the entire contents of which are incorporated herein by reference.

BACKGROUND

(a) Technical Field

The present disclosure relates to a device for preventing the air of a reservoir tank for a vehicle from flowing backward, and more specifically, to a device for preventing the backward air flow of a reservoir tank for a vehicle, which may prevent the coolant and air within a reservoir tank from flowing back toward an engine.

(b) Background Art

As is well known, coolant circulates between an engine and a radiator by the driving of a water pump for cooling the engine of an internal combustion engine vehicle.

Referring to FIG. 1 illustrating an engine cooling system, a reservoir tank 30 in which coolant is stored is connected between a radiator 10 and an engine 20 by a separate line.

A coolant inflow line 31 is connected between the inlet side of the reservoir tank 30 and the radiator 10, and a coolant discharge line 32 is connected between the outlet side of the reservoir tank 30 and the engine 20.

Therefore, when the coolant temperature of the radiator 10 is increased to a predetermined temperature or more and the volume thereof is increased, the coolant is overflowed from the radiator 10 and introduced into the reservoir tank 30 along the coolant inflow line 31, whereas when the amount of coolant introduced into the reservoir tank 30 exceeds a predetermined level, the coolant is discharged to be circulatable toward the engine 20 through the coolant discharge line 32.

Meanwhile, the engine includes a coolant line through which coolant circulates, and when air (e.g., air bubble or the like) exists within the coolant line, cooling performance deteriorates, and coolant flow sound may be generated.

To solve the problem, as illustrated in FIG. 1, a degassing hose 33 is connected between an upper space 35 (space in which coolant is not filled) of the reservoir tank 30 and a portion (e.g., coolant line of a turbo-charger) of the coolant line of the engine 20 in which air collection is intensively needed.

Therefore, the air (e.g., air bubble or the like) generated in the portion of the coolant line of the engine 20 in which the air collection is intensively needed is introduced into and collected in the upper space 35 of the reservoir tank 30 through the degassing hose 33.

At this time, as the coolant circulation line pressure between the radiator 10 and the engine 20 is smaller than the pressure within the reservoir tank 30 in a specific operation condition of the engine, as illustrated in FIG. 2, there may occur the phenomenon in which the coolant within the reservoir tank 30 flows back to the radiator 10 along the coolant inflow line 31 or the air collected within the reservoir tank 30 flows back to the portion of the coolant line of the engine 20 in which the air collection is intensively needed through the degassing hose 33.

Particularly, when the air collected within the reservoir tank 30 flows back to the portion of the coolant line of the engine 20 in which the air collection is intensively needed through the degassing hose 33 again, a problem in that noise such as coolant flow sound is momentarily generated and a problem of degrading engine cooling performance are caused.

The above information disclosed in this Background section is only for enhancement of understanding of the background of the disclosure and accordingly it may contain information that does not form the prior art that is already known in this country to a person of ordinary skill in the art.

SUMMARY

The present disclosure is intended to solve the above conventional problems, and an object of the present disclosure is to provide a device for preventing the backward air flow of a reservoir tank for a vehicle, which may mount an backward air flow prevention hose extending to the inside of the coolant on a connector of the reservoir tank to which a degassing hose is connected, and form an air collection slit hole communicating with an upper space of the reservoir tank in the upper portion of the tube to be openable or closable, thereby easily preventing the phenomenon in which the air within the reservoir tank flows back toward an engine, and easily collecting the air introduced from the engine side.

To achieve the object, the present disclosure provides a device for preventing the backward air flow of a reservoir tank for a vehicle, the device including an backward air flow prevention tube having an upper end connected to a rear portion of a connector of a reservoir tank to which a degassing hose is connected, and a lower end extending to the inside of coolant within the reservoir tank, an air collection slit hole formed to communicate with an upper space of the reservoir tank in the upper portion of the backward air flow prevention tube, and an opening and closing structure disposed within the backward air flow prevention tube to open the air collection slit hole in order to open or close the air collection slit hole only when the collected air is introduced into the backward air flow prevention tube from the degassing hose.

According to an exemplary embodiment of the present disclosure, the opening and closing structure comprises a buoyancy ball, which is inserted into the backward air flow prevention tube, and rests on the coolant within the reservoir tank.

The buoyancy ball is configured to close the air collection slit hole when floating on the coolant, and to open the air collection slit hole by moving downward by the pressure of the collected air introduced into the backward air flow prevention tube from the degassing hose.

Preferably, a partition wall surrounding the lower end of the backward air flow prevention tube is formed on the bottom surface of the reservoir tank in order to prevent the buoyancy ball from being separated.

According to another exemplary embodiment of the present disclosure, the opening and closing structure comprises a buoyancy pipe inserted into the backward air flow prevention tube and floating on the coolant.

The buoyancy pipe is configured to close the air collection slit hole when floating on the coolant, and to open the air collection slit hole by moving downward by the pressure of the collected air introduced into the backward air flow prevention tube from the degassing hose.

Preferably, the buoyancy pipe is adopted to have the vertical length adjusted according to the formation location of the air collection slit hole formed in the backward air flow prevention tube.

The present disclosure provides the following effects through the above configuration.

First, the backward air flow prevention tube extending to the coolant is mounted on the connector of the reservoir tank to which the degassing hose is connected, thereby preventing the phenomenon in which the air within the reservoir tank flows back toward the coolant line of the engine through the degassing hose, and thus solving the conventional problem in that the noise such as air flow sound by the backward air flow occurs and the conventional problem of degrading the engine cooling performance.

Second, by forming the air collection slit hole communicating with the upper space of the reservoir tank in the upper portion of the backward air flow prevention tube, and embedding the opening and closing structure such as a buoyancy ball or buoyancy pipe for opening or closing the slit hole within the backward air flow prevention tube, the air collection slit hole is opened only if the opening and closing structure moves downward by the pressure of the collected air introduced from the engine side through the degassing hose, such that the collected air (e.g., the air generated in the portion of the coolant line of the engine in which the air collection is intensively needed) may be easily introduced into and collected in the upper space of the reservoir tank through the air collection slit hole.

It is understood that the term "automotive" or "vehicular" or other similar term as used herein is inclusive of motor automotives in general such as passenger automobiles including sports utility automotives (operation SUV), buses, trucks, various commercial automotives, watercraft including a variety of boats and ships, aircraft, and the like, and includes hybrid automotives, electric automotives, plug-in hybrid electric automotives, hydrogen-powered automotives and other alternative fuel automotives (e.g., fuels derived from resources other than petroleum). As referred to herein, a hybrid automotive is an automotive that has two or more sources of power, for example both gasoline-powered and electric-powered automotives.

BRIEF DESCRIPTION OF THE FIGURES

The above and other features of the present disclosure will now be described in detail with reference to certain exemplary examples thereof illustrated in the accompanying drawings which are given herein below by way of illustration only, and thus are not limitative of the present disclosure, and wherein.

Figure 1:
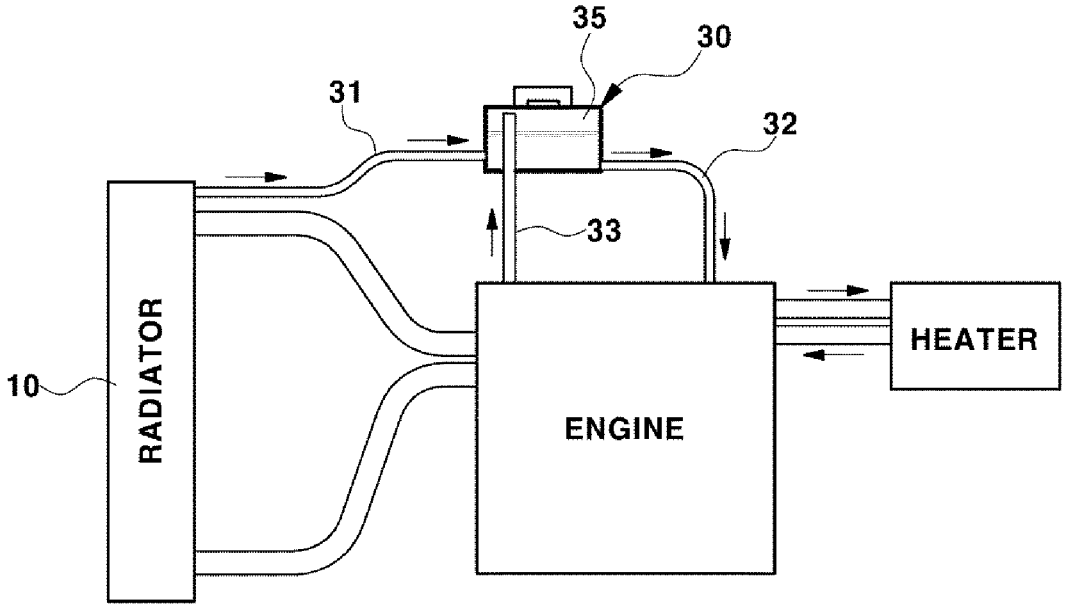
FIG. 1 PRIOR ART
FIGS. 1 and 2 are diagrams illustrating a configuration of an engine cooling system of the prior art.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in section by the particular intended application and use environment.

In the figures, reference numbers refer to the same or equivalent sections of the present disclosure throughout the several figures of the drawing.

DETAILED DESCRIPTION

Hereinafter, a preferred exemplary embodiment of the present disclosure will be described in detail with reference to the accompanying drawings.

As described above with reference to FIG. 1, when the air (e.g., air bubble or the like) exists within the coolant line included in the engine, the cooling performance may deteriorate, and the coolant flow sound may be generated, such that a degassing hose 33 is connected between the upper space 35 (the space in which coolant is not filled) of the reservoir tank 30 and the portion (e.g., the coolant line of the turbo-charger) of the coolant line of the engine 20 in which the air collection is intensively needed.

Therefore, the air (e.g., air bubble or the like) generated in the portion of the coolant line of the engine 20 in which the air collection is intensively needed may be introduced into and collected in the upper space 35 of the reservoir tank 30 through the degassing hose 33.

Figure 2:
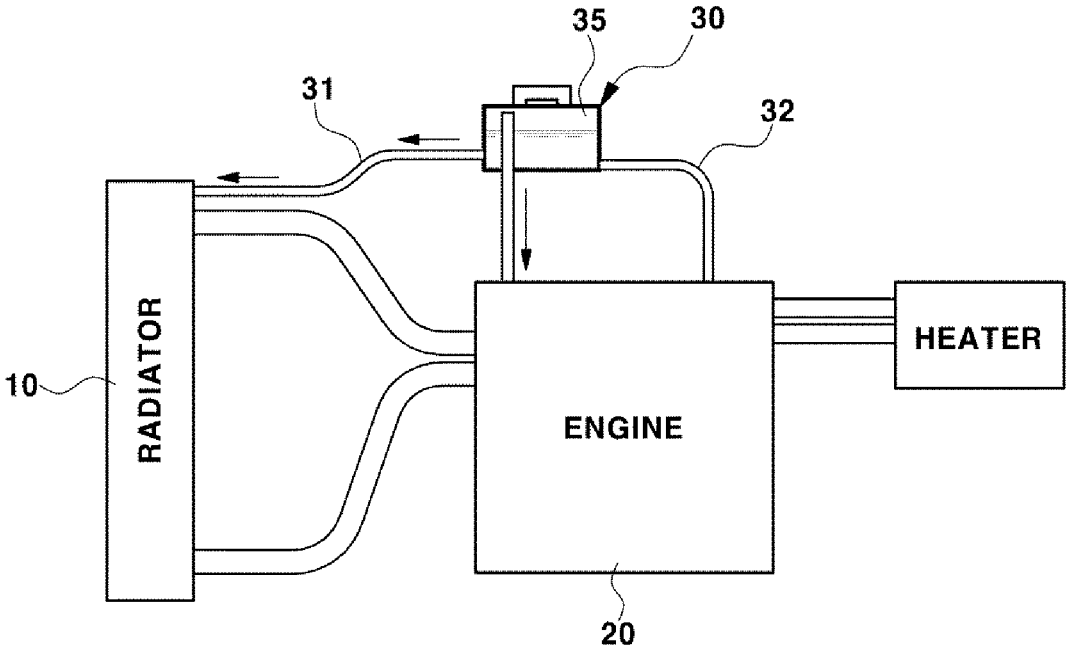
FIG. 2 PRIOR ART
Figure 3A:
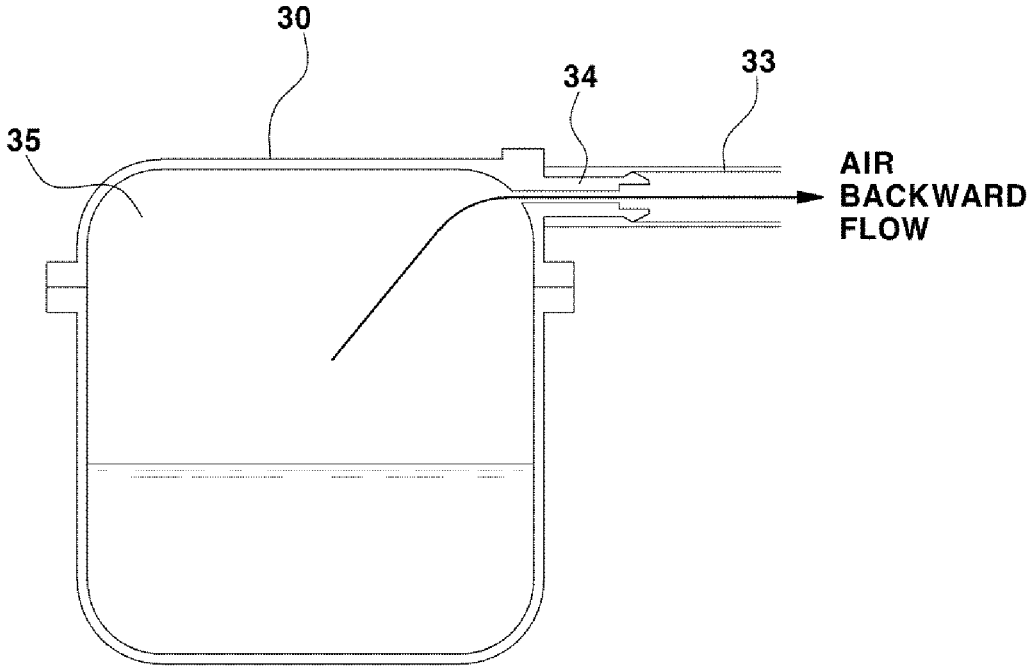
FIG. 3A PRIOR ART
FIG. 3A illustrates a backward air flow phenomenon within a reservoir tank.

However, as illustrated in FIGS. 2 and 3A, there may occur the phenomenon in which the air collected within the reservoir tank 30 flows back to the portion of the coolant line of the engine 20 in which the air collection is intensively needed through the degassing hose 33 again in a specific operation condition of the engine, thereby generating noise such as the momentary coolant flow sound due to the backward air flow, and degrading the engine cooling performance due to the backward-flowed air.

Figure 3B:
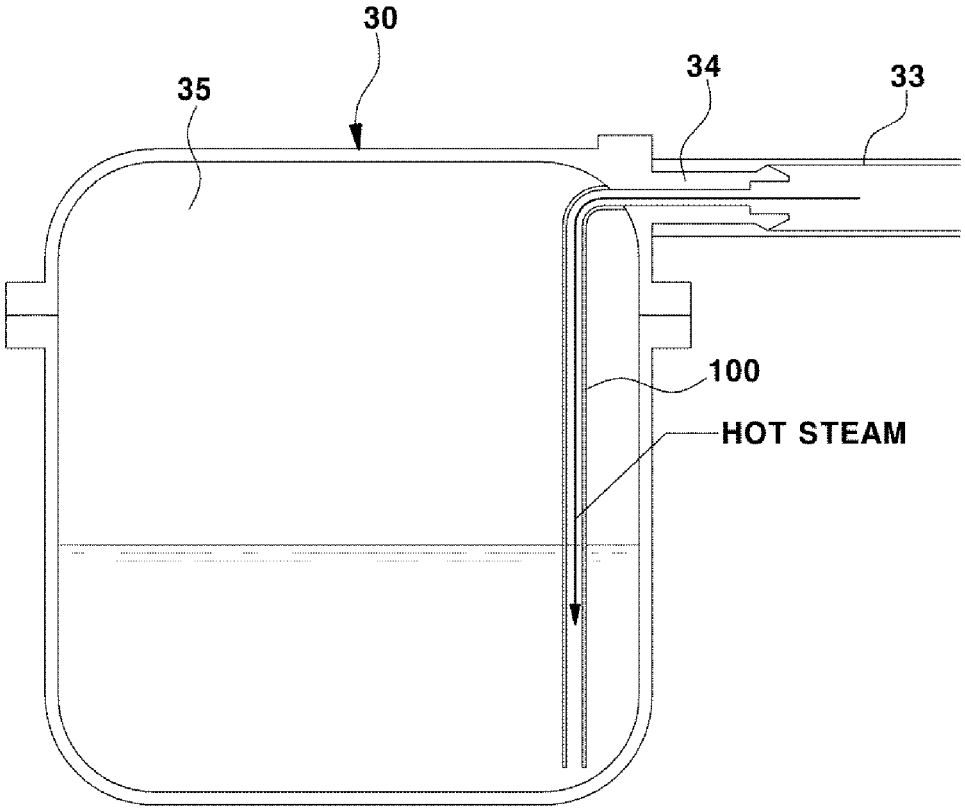
FIG. 3B PRIOR ART
FIG. 3B is a cross-section diagram illustrating a state where only an backward air flow prevention tube is mounted within the reservoir tank.

To eliminate the phenomenon in which the air within the reservoir tank flows back toward the engine through the degassing hose, as illustrated in FIG. 3B, an backward air flow prevention tube 100 may be mounted within the reservoir tank 30.

More specifically, the upper end of the backward air flow prevention tube 100 is connected to the rear portion of a connector 34 of the reservoir tank 30, to which the degassing hose 33 is connected, and the lower end thereof extends to and is arranged inside the coolant within the reservoir tank 30, such that the upper space 35 of the reservoir tank 30 in which air exists becomes a state of being blocked with the degassing hose 33 by the coolant.

Therefore, as described above, the upper space 35 of the reservoir tank 30 in which air exists becomes the state of being blocked with the degassing hose 33, thereby preventing the air existing in the upper space 35 of the reservoir tank 30 from flowing back to the portion of the coolant line of the engine 20 in which air collection is intensively needed again through the degassing hose 33.

At this time, the air generated in the portion of the coolant line of the engine 20 in which the air collection is intensively needed passes through the degassing hose 33, and then may be introduced into and collected in the coolant stored in the reservoir tank 30 through the backward air flow prevention tube 100.

However, when the air generated in the portion of the coolant line of the engine 20 in which air collection is intensively needed is in a hot steam state, there is a problem in that as the coolant is boiled by the hot steam, a boiling noise is generated.

To solve the problem, the present disclosure may prevent the phenomenon in which the air within the reservoir tank flows back toward the coolant line of the engine through the degassing hose, and be configured such that the air generated in the portion of the coolant line of the engine in which the air collection is intensively needed may be easily introduced into and collected in the upper space (the space in which coolant is not filled) of the reservoir tank.

Figure 4:
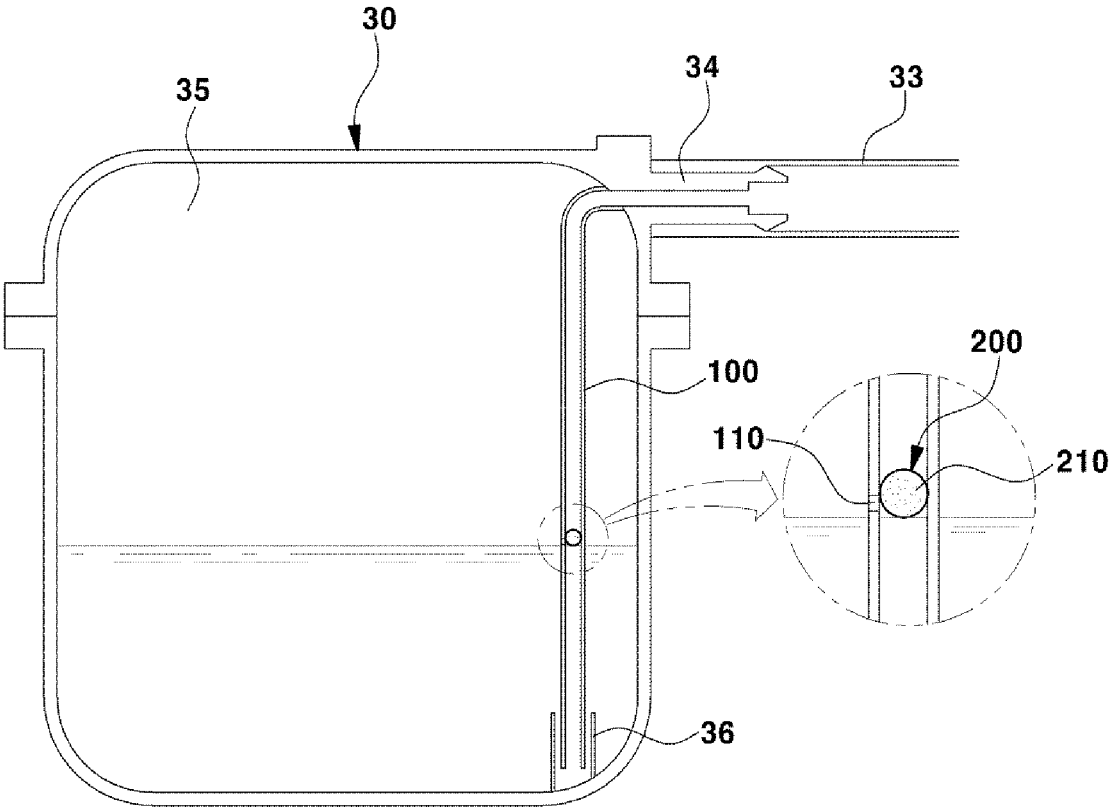
FIGS. 4 and 5 are cross-section diagrams illustrating a device for preventing the backward air flow of a reservoir tank for a vehicle according to an exemplary embodiment of the present disclosure.
Figure 5:
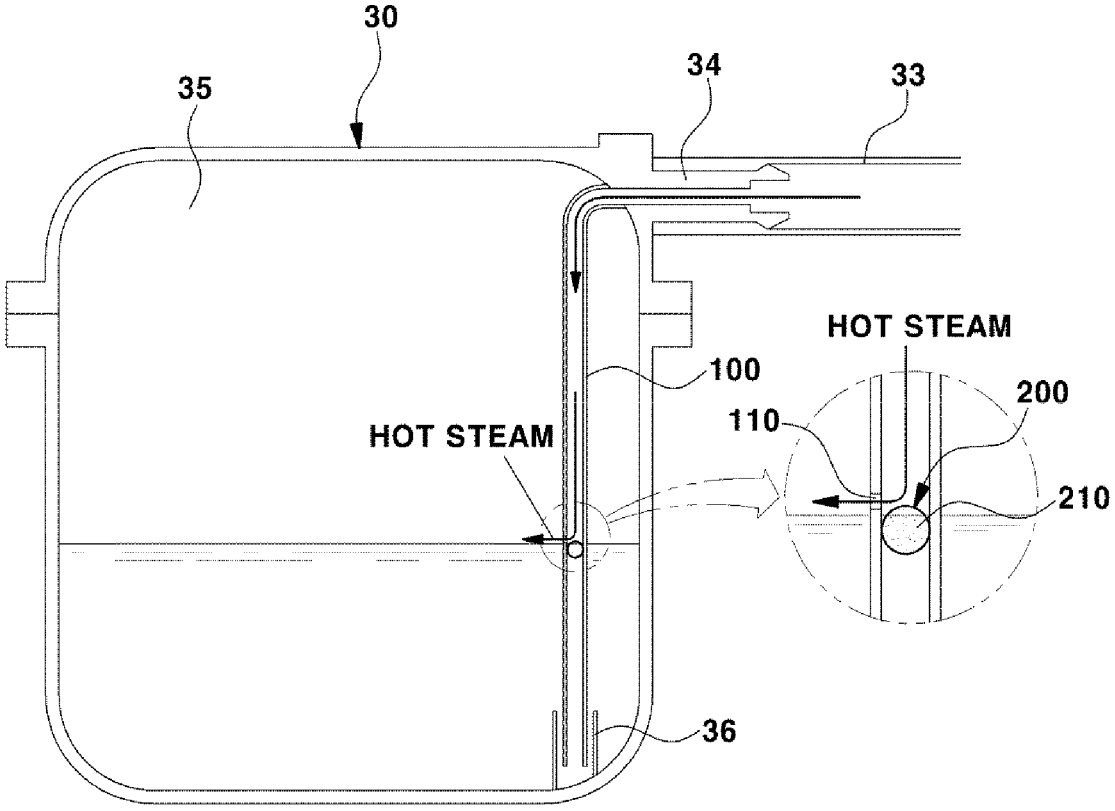

FIGS. 4 and 5 are cross-sectional diagrams illustrating a backward air flow prevention device of a reservoir tank for a vehicle according to an exemplary embodiment of the present disclosure.

As illustrated in FIGS. 4 and 5, the backward air flow prevention tube 100 is mounted within the reservoir tank 30.

That is, the upper end of the backward air flow prevention tube 100 is connected to the rear portion of the connector 34 of the reservoir tank 30 to which the degassing hose 33 is connected, and the lower end thereof extends to and is arranged inside the coolant within the reservoir tank 30, such that the upper space 35 of the reservoir tank 30 in which air exists becomes a state of being blocked with the degassing hose 33 by the coolant.

At this time, an air collection slit hole 110 communicating with the upper space 35 of the reservoir tank 30 is formed in the upper portion of the backward air flow prevention tube 100.

Particularly, an opening and closing structure 200 floating on the coolant is embedded inside the backward air flow prevention tube 100 in order to open or close the air collection slit hole 110.

The opening and closing structure 200 is normally arranged at a location of closing the air collection slit hole 110 inside the backward air flow prevention tube 100, and serves to open the air collection slit hole 110 by moving downward only when the collected air is introduced into the backward air flow prevention tube 100 from the degassing hose 33.

As shown in FIGS. 4 and 5, the opening and closing structure comprises a buoyancy ball 210 which is inserted into the backward air flow prevention tube 100, and floats on the coolant within the reservoir tank 30.

As illustrated in FIG. 4, the buoyancy ball 210 closes the air collection slit hole 110 when floating on the coolant, normally, that is, before the air generated in the portion of the coolant line of the engine in which the air collection is intensively needed is introduced into the backward air flow prevention tube 100 through the degassing hose 33.

Therefore, the backward air flow prevention tube 100 communicating with the degassing hose 33 and the upper space 35 of the reservoir tank 30 may become the state of being blocked by the buoyancy ball 210 closing the air collection slit hole 110, thereby easily preventing the phenomenon in which the air existing in the upper space 35 of the reservoir tank 30 flows back to the portion of the coolant line of the engine 20 in which the air collection is intensively needed through the degassing hose 33 again.

On the other hand, if the collected air (the air generated in the portion of the coolant line of the engine in which the air collection is intensively needed) is introduced into the backward air flow prevention tube 100 from the degassing hose 33, the buoyancy ball 210 moves downward by the pressure of the collected air, such that the air collection slit hole 110 becomes a state of being opened.

Therefore, the collected air, that is, the air generated in the portion of the coolant line of the engine in which the air collection is intensively needed may be easily introduced into and collected in the upper space 35 of the reservoir tank 30 through the air collection slit hole 110 being in the opened state.

Meanwhile, to prevent the buoyancy ball 210 from being separated from the backward air flow prevention tube 100, a partition wall 36 surrounding the lower end of the backward air flow prevention tube 100 may be further formed on the bottom surface of the reservoir tank 30.

As described above, the exemplary embodiment of the present disclosure may prevent the phenomenon in which the air within the reservoir tank 30 flows back toward the coolant line of the engine through the degassing hose 33, and also be configured such that the air generated in the portion of the coolant line of the engine in which the air collection is intensively needed may be easily introduced into and collected in the upper space 35 of the reservoir tank 30.

Figure 6:
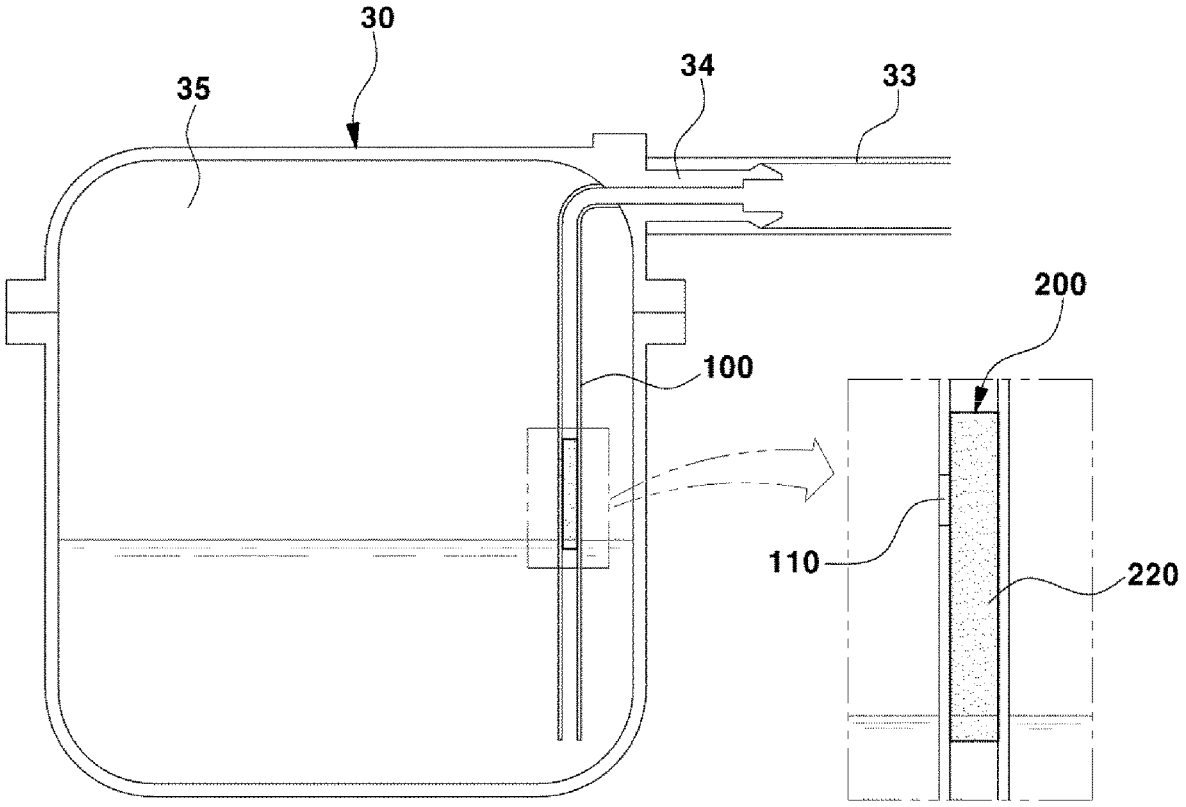
FIGS. 6 and 7 are cross-sectional diagrams illustrating a device for preventing the backward air flow of a reservoir tank for a vehicle according to another exemplary embodiment of the present disclosure.
Figure 7:
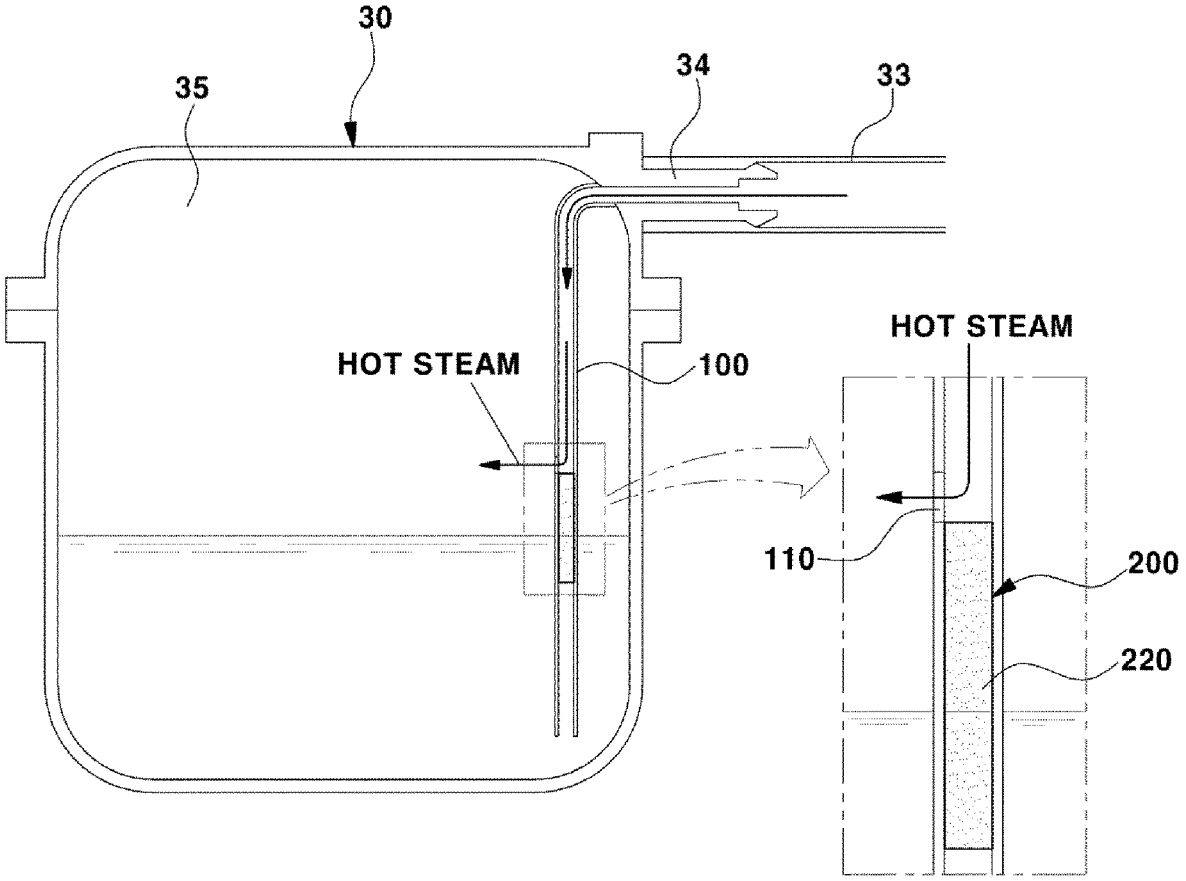

FIGS. 6 and 7 are cross-sectional diagrams illustrating a device for preventing the backward air flow of a reservoir tank for a vehicle according to another exemplary embodiment of the present disclosure.

As illustrated in FIGS. 6 and 7, the backward air flow prevention tube 100 is mounted within the reservoir tank 30.

That is, the upper end of the backward air flow prevention tube 100 is connected to the rear portion of the connector 34 of the reservoir tank 30 to which the degassing hose 33 is connected, and the lower end thereof extends to and is arranged inside the coolant within the reservoir tank 30, such that the upper space 35 of the reservoir tank 30 in which air exists becomes a state of being blocked with the degassing hose 33 by the coolant.

At this time, the air collection slit hole 110 communicating with the upper space 35 of the reservoir tank 30 is formed in the upper portion of the backward air flow prevention tube 100.

Particularly, the opening and closing structure 200 floating on the coolant is embedded inside the backward air flow prevention tube 100 in order to open or close the air collection slit hole 110.

According to another exemplary embodiment of the present disclosure, the opening and closing structure comprises a buoyancy pipe 220 inserted into the backward air flow prevention tube 100 and floating on the coolant within the reservoir tank 30.

The buoyancy pipe 220 has a vertically long rod shape, and serves to normally close the air collection slit hole 110 when floating on the coolant, and to open the air collection slit hole 110 by moving downward by the pressure of the collected air introduced into the backward air flow prevention tube 100 from the degassing hose 33.

At this time, when the air collection slit hole 110 formed in the backward air flow prevention tube 100 is close to the coolant surface, there likely occurs the phenomenon in which the collected air in the hot steam state introduced through the air collection slit hole 110 is in direct contact with the coolant to boil the coolant.

To prevent the problem, the air collection slit hole 110 formed in the backward air flow prevention tube 100 is formed at a location higher than the coolant surface, and also, the buoyancy pipe 220 having the vertically long rod shape is adopted as the opening and closing structure 200 for opening or closing the air collection slit hole 110.

As illustrated in FIG. 6, the buoyancy pipe 220 closes the air collection slit hole 110 when floating on the coolant normally, that is, before the air generated in the portion of the coolant line of the engine in which the air collection is intensively needed is introduced into the backward air flow prevention tube 100 through the degassing hose 33.

On the other hand, if the collected air (the air generated in the portion of the coolant line of the engine in which the air collection is intensively needed) is introduced into the backward air flow prevention tube 100 from the degassing hose 33, the buoyancy pipe 220 moves downward by the pressure of the collected air, such that the air collection slit hole 110 becomes a state of being opened.

Therefore, the collected air, that is, the air generated in the portion of the coolant line of the engine in which the air collection is intensively needed may be easily introduced into and collected in the upper space 35 of the reservoir tank 30 through the air collection slit hole 110 being in the opened state.

As described above, another exemplary embodiment of the present disclosure may prevent the phenomenon in which the air within the reservoir tank 30 flows back toward the coolant line of the engine through the degassing hose 33, and also be configured such that the air generated in the portion of the coolant line of the engine in which the air collection is intensively needed may be easily introduced into and collected in the upper space 35 of the reservoir tank 30.

Further, another exemplary embodiment of the present disclosure may form the air collection slit hole 110 formed in the backward air flow prevention tube 100 at a location higher than the coolant surface, and also adopt the opening and closing structure 200 for opening or closing the air collection slit hole 110 as the buoyancy pipe 220 having the vertically long rod shape, thereby avoiding the direct contact with the coolant to prevent the coolant boiling phenomenon even if the collected air in the hot steam state is introduced into the upper space 35 of the reservoir tank 30 through the air collection slit hole 110.

Figure 8:
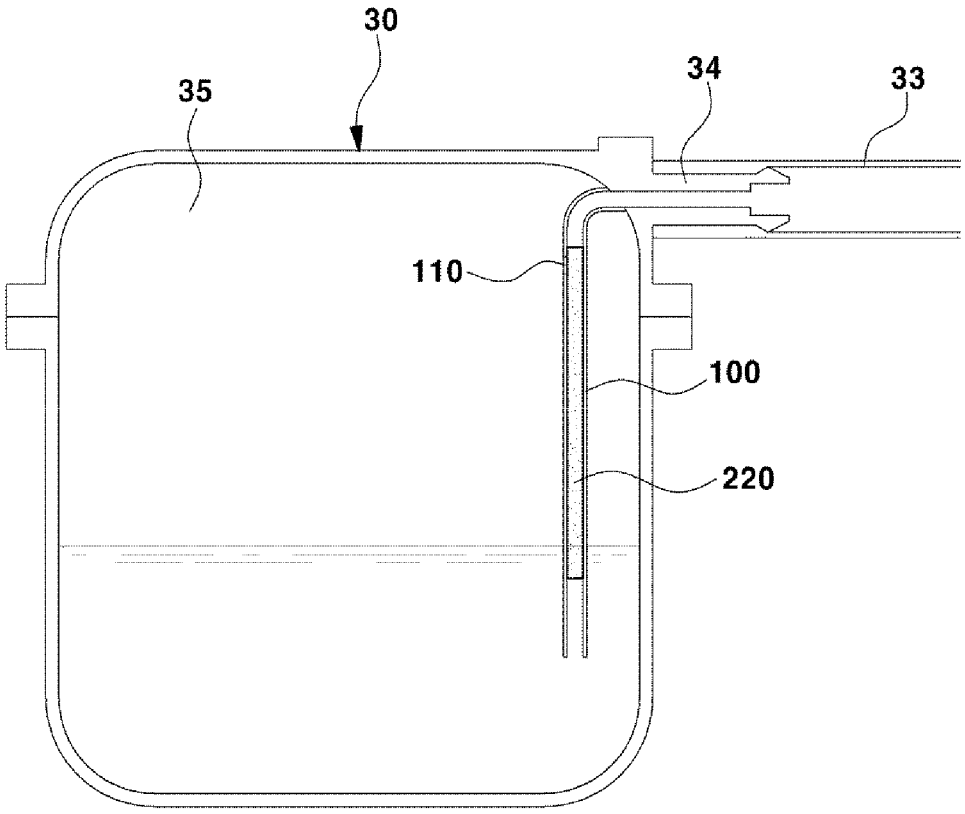
FIGS. 8 and 9 are cross-sectional diagrams illustrating a device for preventing the backward air flow of a reservoir tank for a vehicle according to still another exemplary embodiment of the present disclosure.
Figure 9:
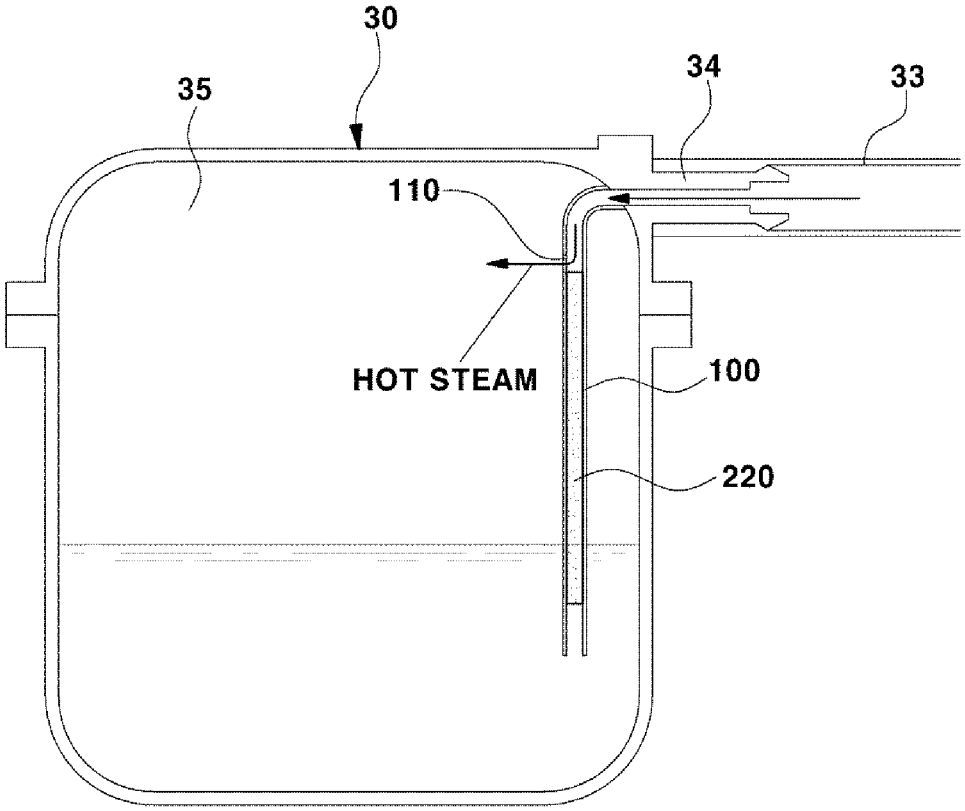

FIGS. 8 and 9 are cross-sectional diagrams illustrating a device for preventing the backward air flow of a reservoir tank for a vehicle according to still another exemplary embodiment of the present disclosure.

According to an exemplary embodiment of the present disclosure, the buoyancy pipe 220 may have the vertical length adjusted according to the formation location of the air collection slit hole 110 formed in the backward air flow prevention tube 100.

For example, as illustrated in FIGS. 8 and 9, the air collection slit hole 110 formed in the air backward prevention tube 100 is formed at a location as high as possible so as to fundamentally block the direct contact with the coolant even if the collected air in the hot steam state is introduced into the upper space 35 of the reservoir tank 30, and the buoyancy pipe 220 having maximally increased vertical length may also be applied in order to open or close the air collection slit hole 110.

As illustrated in FIG. 8, the buoyancy pipe 220 closes the air collection slit hole 110 when floating on the coolant normally, that is, before the air generated in the portion of the coolant line of the engine in which the air collection is intensively needed is introduced into the backward air flow prevention tube 100 through the degassing hose 33.

On the other hand, if the collected air (the air generated in the portion of the coolant line of the engine in which the air collection is intensively needed) is introduced into the backward air flow prevention tube 100 from the degassing hose 33, the buoyancy pipe 220 moves downward by the pressure of the collected air, such that the air collection slit hole 110 becomes a state of being opened.

Therefore, the collected air, that is, the air generated in the portion of the coolant line of the engine in which the air collection is intensively needed may be easily introduced into and collected in the upper space 35 of the reservoir tank 30 through the air collection slit hole 110 being in the opened state.

As described above, another exemplary embodiment of the present disclosure may prevent the phenomenon in which the air within the reservoir tank 30 flows back toward the coolant line of the engine through the degassing hose 33, and also be configured such that the air generated in the portion of the coolant line of the engine in which the air collection is intensively needed may be easily introduced into and collected in the upper space 35 of the reservoir tank 30.

Further, another exemplary embodiment of the present disclosure may form the air collection slit hole 110 formed in the backward air flow prevention tube 100 at a location as high as possible which may be maximally away from the coolant surface, and also apply the buoyancy pipe 220 having maximally increased vertical length for opening or closing the air collection slit hole 110 in order to open or close the air collection slit hole 110, thereby fundamentally blocking the direct contact with the coolant to completely prevent the coolant boiling phenomenon even if the collected air in the hot steam state is introduced into the upper space 35 of the reservoir tank 30 through the air collection slit hole 110.

While a number of exemplary aspects and embodiments have been discussed above, those of skill in the art will recognize that still further modifications, permutations, additions and sub-combinations thereof of the features of the disclosed embodiments are still possible.

The invention claimed is:

1. A device for preventing the backward air flow of a reservoir tank for a vehicle comprising:

a backward air flow prevention tube having an upper end connected to a rear portion of a connector of a reservoir tank, the rear portion of the reservoir tank being connected to a degassing hose, and a lower end extending to an inside of coolant within the reservoir tank;

an air collection slit hole communicating with an upper space of the reservoir tank in the upper end of the backward air flow prevention tube; and an opening and closing structure disposed within the backward air flow prevention tube to open the air collection slit hole to open or close the air collection slit hole when the collected air is introduced into the backward air flow prevention tube from the degassing hose.

2. The device for preventing the backward air flow of the reservoir tank for the vehicle of claim 1, wherein the opening and closing structure comprises a buoyancy ball inserted into the backward air flow prevention tube, and floating on the coolant within the reservoir tank.

3. The device for preventing the backward air flow of the reservoir tank for the vehicle of claim 2, wherein the buoyancy ball is configured to close the air collection slit hole when floating on the coolant, and to open the air collection slit hole by moving downward by the pressure of the collected air introduced into the backward air flow prevention tube from the degassing hose.

4. The device for preventing the backward air flow of the reservoir tank for the vehicle of claim 2, wherein a partition wall surrounding the lower end of the backward air flow prevention tube is formed on the bottom surface of the reservoir tank in order to prevent the buoyancy ball from being separated.

5. The device for preventing the backward air flow of the reservoir tank for the vehicle of claim 1, wherein the opening and closing structure comprises a buoyancy pipe inserted into the backward air flow prevention tube and floating on the coolant.

6. The device for preventing the backward air flow of the reservoir tank for the vehicle of claim 5, wherein the buoyancy pipe is configured to close the air collection slit hole when floating on the coolant, and to open the air collection slit hole by moving downward by the pressure of the collected air introduced into the backward air flow prevention tube from the degassing hose.

7. The device for preventing the backward air flow of the reservoir tank for the vehicle of claim 5, wherein the buoyancy pipe has a vertical length adjusted according to a formation location of the air collection slit hole formed in the backward air flow prevention tube.

* * * * *